United States Patent [19]

Mariol

[11] 4,449,474

[45] May 22, 1984

[54] PERSONAL SECURITY DEVICE

[75] Inventor: James F. Mariol, Cincinnati, Ohio

[73] Assignee: Suzi Stone Enterprises, Inc., Cincinnati, Ohio

[21] Appl. No.: 407,729

[22] Filed: Aug. 13, 1982

[51] Int. Cl.[3] ..... G08B 15/02; G08B 7/00

[52] U.S. Cl. ..... 116/2; 116/7; 116/137 R; 116/214; 116/DIG. 44; 222/182; 42/1 G; 206/38; 220/8; 362/96; 362/116

[58] Field of Search ..... 116/1–7, 116/67 R, 87, 88, 99, 137 R, DIG. 44, 112, 214, 70; 340/321, 326, 331, 388, 404; 362/110–114, 116, 118, 96, 156, 802; 222/3, 175, 192, 509, 182, 183.5, 39; 46/179; 42/1 G, 1 H, 1 ST; 431/358, 357, 361, 365; 239/340, 342; 200/60, 61.86, 61.93; 206/38, 234; 220/8; 354/143, 144, 187, 288

[56] References Cited

U.S. PATENT DOCUMENTS

| | | | |
|---|---|---|---|
| 2,278,870 | 1/1940 | Flagg | 70/456 R |
| 2,468,829 | 7/1947 | Porta | 116/67 R |
| 2,708,073 | 1/1954 | Mohylowski | 362/116 |
| 2,737,574 | 3/1956 | Muller | 362/116 |
| 2,782,748 | 2/1957 | Zegarowitz | 116/112 |
| 2,908,244 | 10/1959 | Clark | 116/67 R |
| 2,940,641 | 6/1960 | Norrish et al. | 222/183 |
| 3,119,564 | 1/1964 | Zalman | 362/116 |
| 3,142,833 | 7/1964 | Bosley et al. | 340/321 |
| 3,794,791 | 2/1974 | Thomson | 200/61.93 |
| 4,032,940 | 6/1977 | Chan | 354/219 |
| 4,130,083 | 12/1978 | Bouchard et al. | 116/5 |
| 4,223,804 | 9/1980 | Morris et al. | 222/3 |
| 4,247,844 | 11/1980 | Zapolski et al. | 340/321 |
| 4,314,316 | 2/1982 | Gertler et al. | 362/86 |

FOREIGN PATENT DOCUMENTS

| | | | |
|---|---|---|---|
| 1915045 | 3/1969 | Fed. Rep. of Germany | 220/1 T |
| 2916594 | 10/1980 | Fed. Rep. of Germany | 354/144 |

*Primary Examiner*—Steven L. Stephan
*Assistant Examiner*—W. Morris Worth
*Attorney, Agent, or Firm*—Wood, Herron & Evans

[57] ABSTRACT

A personal security device is disclosed which comprises a trigger actuated aerosol canister contained in a two-piece telescoping housing. The canister contains a pressurized offensive odor containing gas such as mercaptoethanol which, when ejected from the canister, emits a loud shrieking noise. Additionally, the gas may, as an additional additive, contain a suspension of fine solid or liquid particles of paint or stain so that the device when actuated, discourages a potential rapist or attacker with offensive odor and noise and also identifies him with a stain. In one preferred embodiment, the telescoping housing also includes a flash-type light which is actuated by the same triggers which actuate the canister. The telescoping housing has a key ring attached at one end and may also have a mechanical whistle at the other end.

13 Claims, 4 Drawing Figures

PERSONAL SECURITY DEVICE

FIELD OF THE INVENTION

This invention relates generally to the field of personal security devices, and, more particularly, to a hand-held device which is a combination keyring and personal security device wherein the personal security device includes a pressurized shriek and offensive odor dispenser. The personal security device also includes a flash-type light and mechanical whistle.

BACKGROUND OF THE INVENTION

Personal security devices have been in existence for some time and are constantly being improved as technology advances. Early security devices typically included a whistle or some type of flashing light which could be actuated by a trigger switch. The alarm means of other earlier security devices include a container having a quantity of air under pressure which emits a piercing sound when released. Personal security devices of this type are intended primarily to scare a would-be attacker away by drawing attention to the scene of the attack.

The development and then successful use of tear gas and other liquid irritants by law enforcement agencies has prompted a change in the design of personal security devices to incorporate such substances. While liquid irritants enable a victim to at least momentarily incapacitate an assailant, a major concern in the design of personal security devices incorporating these substances is the avoidance of accidental discharge. Considering the unpleasant effects of tear gas or other irritants and the fact that purchasers of personal security devices are generally not trained in their use, such devices need to be simple to operate and should provide means to prevent accidental discharge.

Several patents are directed to this general problem as shown, for example, in U.S. Pat. No. 3,794,791 to Thomson. This patent discloses a personal security device which includes a flashlight, a tear gas or liquid spray dispenser and a whistle all contained within a single elongated housing. The flashlight is actuated when a trigger is moved forwardly and the tear gas or liquid dispenser and whistle are actuated when the trigger is pushed downwardly from such forward position. This two-stage motion of the trigger mechanism purportedly minimizes the possibility of accidental release of the tear gas. U.S. Pat. No. 4,223,804 to Morris teaches a personal security device having a flashlight and liquid or tear gas dispenser. Morris includes a pivoted trigger engageable with a pivoted arm to actuate the tear gas dispenser. In the normal closed state, the trigger forms a part of the housing aligned over the exit of the tear gas or liquid dispenser and thus protects the dispensing nozzle from inadvertent actuation. When the trigger is depressed, it moves away from the exit of the tear gas dispenser and at the same time releases the tear gas. Combinations of flashlights and compressed liquid or air-warning devices may also be found in U.S. Pat. Nos. 2,782,748 to Zegarowitz, 4,247,844 to Zapolski and German Pat. No. 1,915,045 to Dallmer.

Although each of the devices disclosed in the patents identified above purport to eliminate the problem of accidental discharge of the compressed gas or liquid they contain, it is believed that a problem of accidental discharge may still exist. In each design, the trigger mechanism which releases the compressed liquid or gas could be exposed and activated by contact with objects in a coat pocket or a woman's purse, for example. In addition, a limitation of such devices is that they would not typically be carried by the user in the hand or coat pocket but would be left in a purse or bag. It is believed that in many purse snatchings, muggings, rapes or assults there may not be sufficient time to reach into a purse, locate a security device and then use it before being attacked.

It has therefore been an object of this invention to provide a personal security device having an offensive odor or other irritant dispensing means actuated by a trigger, which trigger is completely covered in the closed position of a two-section telescoping housing to prevent accidental discharge of the irritant.

It is another object of this invention to provide a personal security device which is simple to operate and would typically be carried in the hand or a coat pocket for ready access at times when an attack would be most likely.

SUMMARY OF THE INVENTION

These and further objects are accomplished with a personal security device according to this invention which is a combined keyring and personal security device. The security device consists of an inner housing which telescopes inwardly and outwardly from an outer housing. A keyring is releasably mounted at one end of the outer housing, and a whistle is preferably formed at the other end of the device in the inner housing. Contained within the inner housing there is an aerosol canister of compressed gas which includes an offensive odorous gas or liquid. When the gas is released from the canister by a trigger normally protected against actuation by the housing, the pressurized gas emits a shrieking offensive noise as well as releases the offensive odor. The pressurized gas may also contain a suspension of paint or stain with which to spray and identify an attacker. The housing also contains a conventional flash cube of the kind commonly used in cameras and a mechanical whistle.

The keyring is so constructed relative to the housing that the keyring may be easily separated from the housing. One common time for an attack is when a person is opening his or her door and has the door key in the lock. Because the keyring is easily separable from the security device housing, the device may be quickly separated if necessary and the door key and attached keyring left in the door, freeing the security device for instant use.

In the non-operating or closed position of the security device, the inner housing is disposed within the outer housing and the device functions primarily as a keyring although the mechanical whistle formed in the inner housing may be used if desired. To operate the pressurized gas container or canister and flash bulb, the inner housing is telescoped outwardly from the outer housing. This uncovers the aperture in the outer housing and exposes an opening in the base of the inner housing in which a finger may be inserted to activate the canister trigger. By depressing the trigger, the canister is moved axially within the inner housing which activates the flash cube creating a temporarily blinding light, as discussed below. In addition, the contents of the canister are released as the trigger is depressed to further discourage a would-be attacker from an assault.

The telescoping structure of this invention provides much more protection from accidental discharge of the pressurized gas than prior art devices. In addition, since the security device has a secondary function of acting as a keyring, it is more likely to be carried or stored in a readily accessible location by the user than prior art designs which are intended for use only as security devices. In addition, the personal security device of this invention incorporates these advantages into a structure which is economical and practical to manufacture.

DESCRIPTION OF THE DRAWINGS

The structure, operation and advantages of this invention will become apparent upon consideration of the following description taken in conjunction with the accompanying drawings wherein.

DETAILED DESCRIPTION OF THE INVENTION

Figure 3:
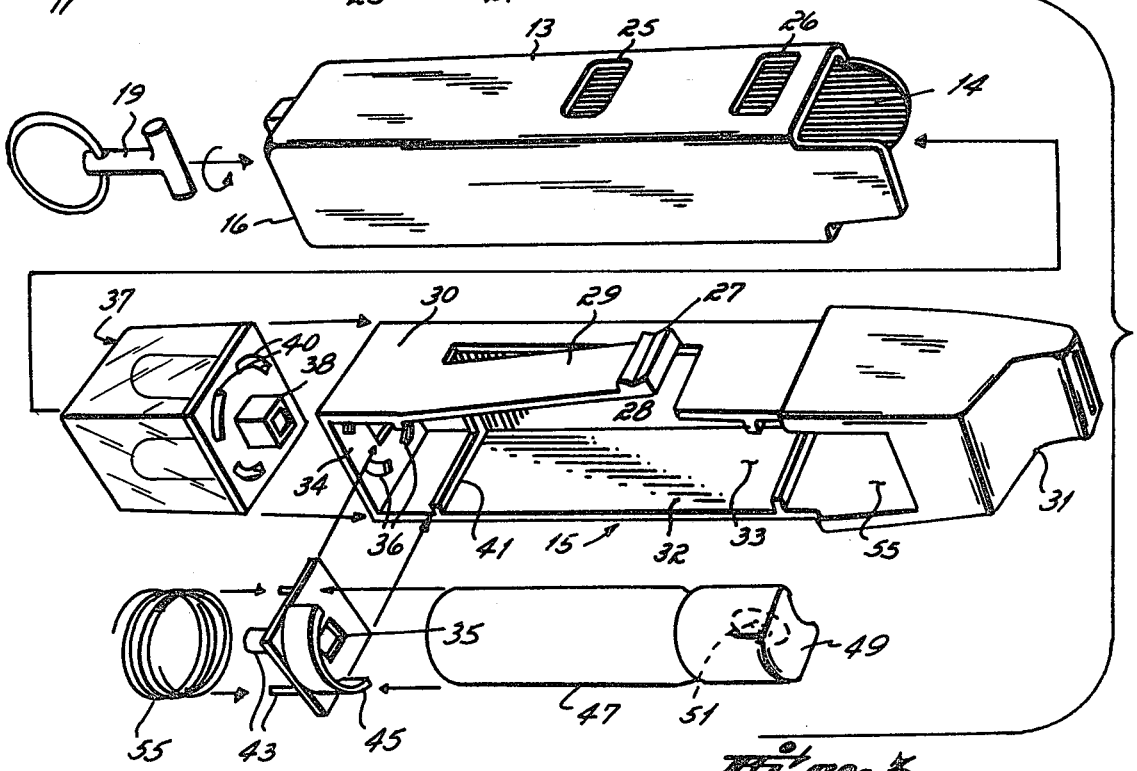
FIG. 3 is an exploded, perspective view of the personal security device herein showing each of the elements.
Figure 4:
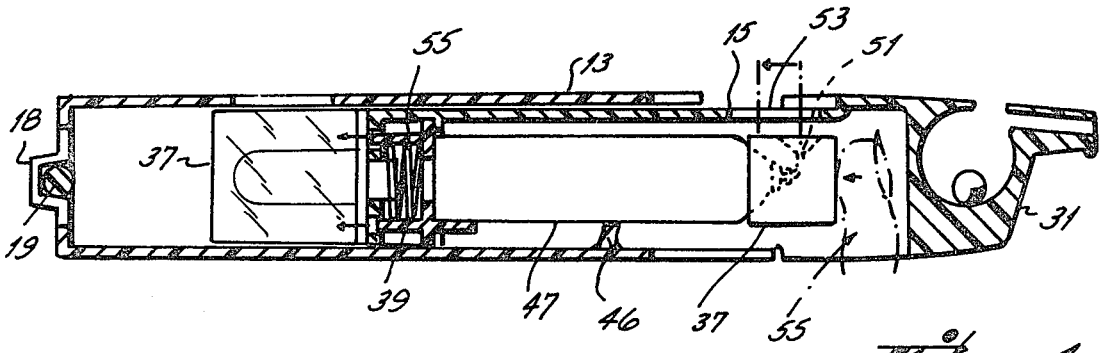
FIG. 4 is a cross-sectional view in full elevation taken generally along line 4—4 of FIG. 2.

Referring now to the drawings, the personal security device of this invention is depicted generally with the reference number 11. Security device 11 comprises a two-piece housing assembly, including an outer housing 13 and an inner housing 15. The outer housing 13 is generally rectangular in shape having an open end 14 to receive the inner housing 15 and a closed end 16 formed with a pair of spaced ears 17 and 18. A T-shaped bar 19 is slid between ears 17, 18 and then twisted 90° to lock it into place within ears 17, 18 as shown in FIGS. 3 and 4. A keyring 21 is connected to bar 19 to receive automobile, dwelling and other keys. Although the keyring 21 is shown as being detachably connected to outer housing 13, it could be fixed thereto in a conventional manner.

Figure 1:
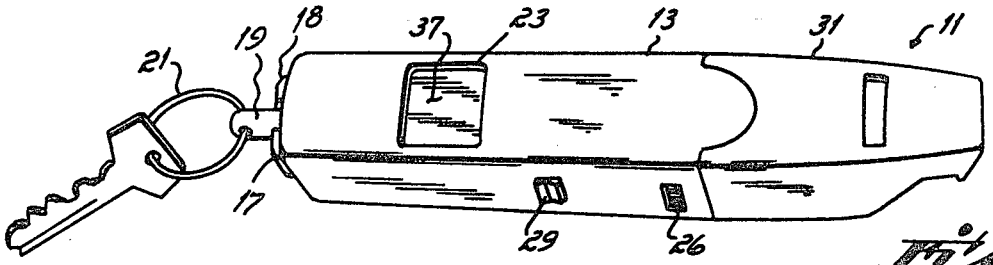
FIG. 1 is a perspective view of a preferred embodiment of this invention in a closed position.
Figure 2:
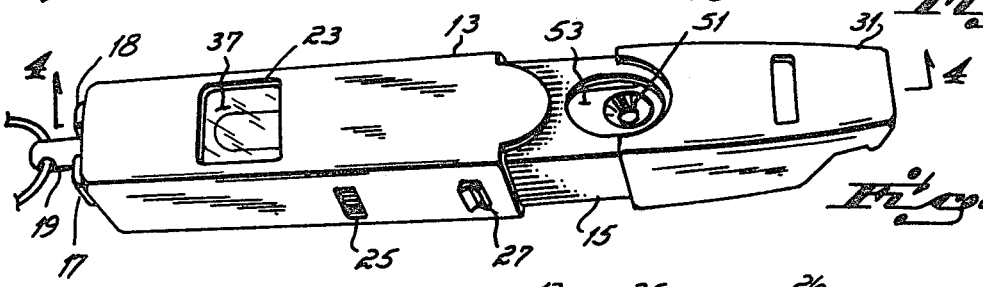
FIG. 2 is the personal security device of FIG. 1 in an extended or open position.

The outer housing 13 also includes an opening 23 covered with a clear material such as glass or plastic which is aligned with the flashing portion of the alarm means herein as discussed below. An inner slot 25 and outer slot 26 are formed in the side of outer housing 13 and are adapted to receive the raised portion 27 of a spring lock 29 which is mounted to the side of inner housing 15 as shown in FIG. 3. The slots 25, 26, in cooperation with spring lock 29, define the open and closed positions of security device 11. The device 11 is placed in a closed, locked position by sliding inner housing 15 within outer housing 13 such that the raised portion 27 of the spring lock 29 engages the inner slot 25. This locks the inner housing 15 in place within the outer housing 13. The inner housing 15 is placed in an extended position for operation of the protection means of device 11 by disengaging raised portion 27 from the inner slot 25 and moving inner housing 15 outwardly until the raised portion 27 engages the outer slot 26. This locks the inner housing 15 in an extended position relative to the outer housing 13 as shown in FIG. 2.

In the extended position of inner housing 15, the primary protection means of security device 11 are exposed for operation. The inner housing 15 is generally rectangular in shape having a top surface 28, two side sections 30, 32 and an open bottom forming a hollow interior 33. One end of the inner housing 15 includes a whistle 31 and the other end 34 is closed except for at least three arcuate openings 36 which are concentrically spaced about a central opening 35. A conventional flash cube 37, having a projection 38, is snap fitted to the closed end 34 of inner housing 15 such that the projection 38 engages the central opening 35. The flash cube 37 is formed with at least three conventional electrical contacts 40 which align with the arcuate openings 36 in closed end 34.

A platform 39 is disposed between the end 34 of inner housing 15 and a raised lip section 41 which extends continuously along the interior of top surface 28 and side section 30, 32. The platform 39 is formed with a series of spaced prongs 43 which align with the arcuate openings 33 in the closed end 34 of inner housing 15. The prongs 43 are slightly different in length for purposes to become apparent below. A spring 55 is disposed between the platform 39 and the inner housing end 34 which holds the platform 39 in place within the inner housing interior 33.

The opposite side of the platform 39 is formed with a curved section 45 which receives one end of a canister 47. A second curved section 46 is mounted to inner housing 15 and spaced from curved sections 45 so that together the curved section 45, 46 hold canister 47 in place within the inner housing interior 33. The canister 47 contains a fine suspension or liquid or solvent such as tear gas, dye, or an odorous substance contained in a pressurized gas. When the canister 47 is opened the escaping compressed gas emits a loud shriek or harsh noise. The end of canister 47 opposite platform 39 includes a trigger 49 having an aperture 51, which trigger 49 is operable to release the contents of canister 47 through aperture 51. A generally circular opening 53 is formed in the top surface 28 of inner housing 15 above the aperture 51, to direct the contents of canister 47 toward a particular target.

As mentioned above, the security device of this invention provides numerous improvements over prior art designs. Such improvements may be best illustrated by a discussion of the operation of security device 11. In the closed position, with inner housing 15 disposed within outer housing 13, the security device 11 functions primarily as a keyring. The trigger 49 which releases the contents of canister 47 is completely covered by the outer housing 13 with the device 11 in the closed position. The provision of spring lock 29 which locks the inner housing 15 into outer housing 13 assures that there is little chance of an inadvertent or accidental actuation of trigger 49 by random objects in a woman's purse, for example, or by simply touching the outer surface of device 11 when reaching for another object. The spring lock 29 must first be depressed and the inner housing 15 extended to activate the protection means of device 11, as discussed more fully below. Thus, the trigger mechanism for the container is completely enclosed and protected by the housing of the device.

In addition, it is apparent that for personal security devices to be effective, they must lend themselves to ready availability in case of emergency. Devices which are intended only for personal security and have no other function may be expected to be stored in a purse or a handbag under normal circumstances. The security device 11 differs from such designs in that it also acts as a keyring for automobile and residential keys so that it will normally be in one's hand when walking to the car or residence which are times when attacks seem to commonly occur.

With the security device 11 in hand, it may be quickly made operational by depressing the raised portion 27 of spring lock 29 so that it disengages inner slot 25, and then moving the inner housing 15 outwardly relative to the outer housing 13 until the raised portion 27 is locked into the outer slot 26. With the inner housing 15 in an extended position, an opening 55 is provided into the inner housing interior 33 allowing one to place a finger on the canister trigger 49. See FIG. 4. As the trigger 49 is depressed, two things happen. First, the canister 47 slides axially a short distance within the inner housing 15 along curved sections 45, 46 thereby moving the platform 39 toward the closed end 34 of inner housing 15. The prongs 41 of the platform 39 are moved through arcuate openings 33 and engage the electrical contacts 40 formed in flash cube 37. As mentioned above and shown in FIG. 3, the prongs 41 are of slightly different length so that as they engage the flash cube contacts 40, the four individual bulbs of the flash cube 37 are activated sequentially rather than simultaneously. This has the effect of producing a prolonged flash which is seen by a would-be attacker through the clear opening 23 in the outer housing 13 which opening 23 aligns with flash cube 37 with the inner housing 15 in an extended position. Virtually simultaneously with the activation of flash cube 37, the trigger 49 causes the contents of canister 47 to be released through aperture 51 and then outwardly through the opening 53 in the upper surface 28 of inner housing 15. As shown in FIG. 4, the canister 47 moves a slight axial distance within inner housing 15 before aperture 51 aligns with the inner housing opening 53. If desired, the whistle 31 may also be utilized before or after the trigger 49 is actuated.

It is anticipated that the combination of the flash cube 37, the canister 47 containing a pressurized offensive odorous liquid and shriek, and the whistle 31 provide at least reasonable security for a variety of situations. For example, the whistle 31 could be useful in instances where an assault is anticipated but has not yet occurred or if an attack on another is being witnessed by the user of security device 11. Where a would-be attacker approaches a potential victim at close range, the security device 11 may be used to temporarily impair and disuade the attacker by spraying the attacker with an offensive odorous liquid and actuating a shriek upon actuating trigger 49. In both instances, the secondary use of security devide 11 as a keyring provides a reason for the user to have the device 11 in hand or within easy access under normal circumstances so that enough time is available for the device 11 to be used should the need arise.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying this invention, but that the invention will include all embodiments falling within the scope of the appended claims.

I claim:

1. A personal security device comprising:

an inner housing having an open interior;

an outer housing formed to receive said inner housing therewith, said inner housing being movable within said outer housing between a closed position wherein the interior of said inner housing is covered by said outer housing and an extended position wherein at least a portion of said inner housing interior is exposed;

protection means disposed within said inner housing, said protection means including:

flash means having at least one electrical contact;

a canister movable within said inner housing and containing a fluid irritant, said canister having a trigger adapted to be depressed for moving said canister within said inner housing and for releasing said fluid irritant from said canister; and activation means disposed between said flash means and said canister, said activation means being operable to engage said electrical contacts for activating said flash means, whereby upon movement of said inner housing to said extended position said trigger is uncovered and then depressed to release said fluid irritant from said canister and move said activation means into engagement with said electrical contacts.

2. The personal security device of claim 1 wherein said outer housing is formed with an opening in alignment with said flash means in the extended position of said inner housing to permit the passage of light therethrough and outwardly of said device.

3. The personal security device of claim 1 wherein a whistle is attached to the outwardly extending end of said inner housing.

4. The personal security device of claim 1 wherein a keyring is releasably mounted to an end of said outer housing.

5. The personal security device of claim 1 wherein said canister is formed with an aperture for the release of said fluid irritant therefrom, and said inner housing is formed with an opening in alignment with said aperture for release of said fluid irritant from said device.

6. The personal security device of claim 1 wherein said flash means is a flash cube having a plurality of individual flash bulbs.

7. The personal security device of claim 1 wherein said activation means include a plurality of prongs each of progressively different length from longer to shorter, and each formed for insertion into one of said electrical contacts, whereby upon movement of said activation means into engagement with said flash means said prongs beginning with the longest one thereof sequentially actuate said electrical contacts of said flash means to provide an extended, essentially continuous flash.

8. A personal security device comprising:

an inner housing having an open interior;

a whistle disposed on one end of said inner housing;

an outer housing formed to receive said inner housing therewithin, said inner housing being movable within said outer housing between a closed position wherein the interior of said inner housing is covered by said outer housing and an extended position wherein at least a portion of said inner housing interior is exposed;

releasable locking means operable to lock said inner housing in said open and closed position;

a keyring mounted to an end of said outer housing;

flash means disposed within said inner housing and having at least one electrical contact;

a canister movably disposed within said inner housing and containing a fluid irritant, said canister having a trigger adapted to be depressed for moving said canister within said inner housing and for releasing said fluid irritant through an aperture formed in said canister;

a spring-biased platform disposed between said flash means and said canister, said platform having a plurality of prongs aligning with respective electrical contacts of said flash means, whereby upon movement of said inner housing to said extended position said trigger is uncovered and then depressed to release said fluid irritant from said canister and to move said canister to advance said prongs of said platform into engagement with said electrical contacts.

9. The personal security device of claim 8 wherein said outer housing is formed with an opening in alignment with said flash means in the extended position of said inner housing to permit the passage of light therethrough and outwardly of said device.

10. The personal security device of claim 8 wherein said flash means is a flash cube having a plurality of individual flash bulbs.

11. The personal security device of claim 8 wherein said platform prongs are each formed of a progressively different length from longer to short whereby upon movement of said canister into engagement with said platform said prongs are advanced and beginning with the largest one thereof sequentially actuate said electrical contacts of said flash means to provide an extended, essentially continuous flash.

12. The personal security device of claim 8 wherein said locking means includes a spring locking bar having a raised portion mounted to said inner housing, and an inner and outer slot formed in said outer housing, said raised portion of said spring locking bar releasably engaging said inner slot to lock said inner housing in said closed position, and releasably engaging said outer slot to lock said inner housing in said extended position.

13. A personal security device comprising:

a generally tubular inner housing having a sidewall and an endwall, said sidewall being formed with an opening;

a general tubular outer housing formed to receive said inner housing therewithin, said inner housing telescoping within said outer housing between a closed position wherein said opening in said sidewall of said inner housing is covered by said outer housing and an extended position wherein said opening in said said sidewall of said inner housing is exposed to receive a thumb or finger; and protection means disposed within said inner housing, said protection means including:

flash means having at least one electrical contact;

a canister movable within said inner housing and containing a pressurized fluid, said canister having a trigger adapted to be depressed for moving said canister within said inner housing and for releasing said pressurized fluid from said canister; and activation means disposed between said flash means and said canister, said activation means being operable to engage said electrical contacts for activating said flash means, whereby upon movement of said inner housing to said extended position said trigger is exposed through said opening in said inner housing and then depressed to release said pressurized fluid from said canister and move said activation means into engagement with said electrical contacts.

* * * * *